US009736893B2

(12) United States Patent
Knoedgen et al.

(10) Patent No.: US 9,736,893 B2
(45) Date of Patent: Aug. 15, 2017

(54) PSRR CONTROL LOOP WITH CONFIGURABLE VOLTAGE FEED FORWARD COMPENSATION

(71) Applicant: Dialog Semiconductor GmbH, Kirchheim/Teck-Nabern (DE)

(72) Inventors: Horst Knoedgen, Munich (DE); Thomas Nedwal, Landau/Pfalz (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 56 days.

(21) Appl. No.: 14/694,077

(22) Filed: Apr. 23, 2015

(65) Prior Publication Data

US 2015/0296574 A1 Oct. 15, 2015

Related U.S. Application Data

(63) Continuation of application No. PCT/EP2013/057606, filed on Apr. 11, 2013.

(30) Foreign Application Priority Data

Oct. 30, 2012 (EP) ..... 12190683

(51) Int. Cl.
*H05B 37/02* (2006.01)
*H05B 33/08* (2006.01)

(52) U.S. Cl.
CPC ..... *H05B 33/08* (2013.01); *H05B 33/0842* (2013.01)

(58) Field of Classification Search
None
See application file for complete search history.

(56) References Cited

U.S. PATENT DOCUMENTS 6,388,399 B1 * 5/2002 Eckel ..... G01K 1/024 315/158
6,980,119 B2 * 12/2005 Toulmin ..... B60Q 1/2611 340/691.1

(Continued)

FOREIGN PATENT DOCUMENTS

WO WO 2012156329 11/2012

OTHER PUBLICATIONS

European Search Report 12190683.8-1807, May 3, 2013, Dialog Semiconductor GmbH.

(Continued)

*Primary Examiner* — Douglas W Owens
*Assistant Examiner* — Srinivas Sathiraju
(74) *Attorney, Agent, or Firm* — Saile Ackerman LLC; Stephen B. Ackerman

(57) ABSTRACT

The present document relates to the compensation of voltage variations within power converters. A driver circuit for a solid state light source is described. The driver circuit comprises a switched-mode power converter comprising a switch; wherein the switched-mode power converter is configured to convert an input voltage at an input of the switched-mode power converter into an output voltage at an output of the switched-mode power converter. Furthermore, the driver circuit comprises current sensing means configured to determine a sensed current signal indicative of a current through the switch; and voltage sensing means configured to determine a sensed voltage signal indicative of the input voltage. In addition, the driver circuit comprises a control unit configured to determine a gate control signal for putting the switch into an off-state, based on the sensed current signal and based on the sensed voltage signal.

25 Claims, 5 Drawing Sheets

(56) References Cited

U.S. PATENT DOCUMENTS

| | | | | |
|---|---|---|---|---|
| 7,038,399 | B2 * | 5/2006 | Lys | H05B 33/0809 315/291 |
| 8,427,069 | B2 * | 4/2013 | Wibben | H05B 33/0887 315/156 |
| 8,786,216 | B2 * | 7/2014 | Williams | H05B 33/083 315/169.1 |
| 8,810,162 | B2 * | 8/2014 | Williams | H05B 33/083 315/169.1 |
| 8,878,440 | B2 * | 11/2014 | Reed | H05B 37/0218 315/130 |
| 9,207,696 | B1 * | 12/2015 | Kronmueller | G05F 1/56 |
| 9,351,364 | B2 * | 5/2016 | Williams | H05B 33/083 |
| 9,408,269 | B2 * | 8/2016 | Zhu | H05B 37/02 |
| 2010/0026208 | A1 * | 2/2010 | Shteynberg | H05B 33/0815 315/297 |
| 2010/0079081 | A1 * | 4/2010 | Zhang | H05B 33/0851 315/291 |
| 2012/0139438 | A1 * | 6/2012 | Soleno | H05B 33/0815 315/291 |
| 2014/0132172 | A1 * | 5/2014 | Zhu | H05B 37/02 315/210 |
| 2014/0132179 | A1 * | 5/2014 | McAuliffe | H02M 3/156 315/291 |

OTHER PUBLICATIONS

German Office Action, Application Number: 12 190 683.8-1807, Applicant: Dialog Semiconductor GmbH, Mail date: Apr. 19, 2016, 4 pgs.

* cited by examiner

PSRR CONTROL LOOP WITH CONFIGURABLE VOLTAGE FEED FORWARD COMPENSATION

TECHNICAL FIELD

The present document relates to power converters. In particular, the present document relates to the compensation of voltage variations within power converters.

BACKGROUND

Solid state light bulb assemblies, e.g. LED or OLED lamps, make use of power converters to convert an input voltage (e.g. derived from the mains supply) into an output voltage for driving the solid state light source. The voltage supply for the light source current control stage should be able to cope with a wide range of voltages at the input. Conventional control solutions suffer from a limited PSRR (power supply rejection ratio) which limits the usable voltage range.

SUMMARY

In the present document, a power converter and a driver circuit for a solid state light source are described which allow extending the voltage limits substantially and which improve current stability for the light sources. This allows the use of smaller storage capacitors at the output of the power converter and driver circuit and extends the range for stable diming. According to an aspect, a driver circuit for a solid state light source (e.g. an LED or OLED light source) is described. The driver circuit may be configured to supply energy taken from a mains supply to the light source. The light source may e.g. be provided with a drive voltage and a drive current generated by the driver circuit. The drive voltage may e.g. correspond to an on-voltage of the solid state light source. The drive current may be used to control the illumination level of the light source.

The driver circuit may comprise a switched-mode power converter comprising a switch. The power converter may comprise one or more of: a flyback converter, a buck converter, a boost converter, a buck-boost converter, and a single-ended primary-inductor converter. In more general terms, the power converter may comprise or may be an inductor-based power converter. The switch may comprise a transistor, e.g. a metal oxide semiconductor field effect transistor. The switched-mode power converter may be configured to convert an input voltage at an input of the switched-mode power converter into an output voltage at an output of the switched-mode power converter. The output voltage may e.g. correspond to the drive voltage which is provided to the light source.

The driver circuit may comprise current sensing means which are configured to determine a sensed current signal indicative of a current through the switch. The current sensing means may comprise a current sensing resistor arranged in series with the switch. As such a voltage drop at the current sensing resistor may be proportional to the current through the switch.

Furthermore, the driver circuit may comprise voltage sensing means configured to determine a sensed voltage signal indicative of the input voltage. The voltage sensing means may comprise a voltage divider arranged in parallel to the input of the switched-mode power converter. The voltage divider may e.g. comprise two resistors arranged in series. The sensed voltage signal may correspond to the voltage drop at one of the resistors, such that the sensed voltage signal is proportional to the input voltage. Alternatively or in addition, the voltage sensing means may comprise an auxiliary winding of a transformer comprised within the switched-mode power converter. As indicated above, the power converter may comprise an inductor such as a transformer. The transformer may be provided with an auxiliary winding or an auxiliary coil and the input voltage may be sensed using the auxiliary winding.

The driver circuit may comprise a control unit configured to determine a gate control signal for putting the switch into an off-state. The gate control signal may be determined based on the sensed current signal and based on the sensed voltage signal. In particular, the time instant for putting the switch into an off-state may be determined based on the sensed current signal and based on the sensed voltage signal. By taking into account the sensed voltage signal in addition to the sensed current signal, the driver circuit (and in particular the control unit) may be configured to control the switch such that a degree of modulations comprised within the output voltage and/or a degree of modulations comprised within a current (e.g. the drive current) provided at the output of the switched-mode power converter (e.g. provided to the light source) and/or a degree of modulations comprised within a power provided at the output of the switched-mode power converter is reduced with respect to a degree of modulations comprised within the input voltage. In other words, variations of the input voltage can be taken into account for the control of the power converter, thereby allowing the power converter to provide a stable/constant output voltage, even when being provided with an input voltage which comprises variations/modulations (e.g. due to distortions induced by a phase-cut dimmer). In yet other words, the control unit may be configured to improve the power supply rejection ratio (PSRR) of the power converter by taking into account the sensed voltage signal when controlling the switch of the power converter.

The control unit may be configured to compensate for a delay between a first time instant when the sensed current signal is determined and a second time instant when the switch is put into the off-state, subject to the gate control signal which corresponds to the sensed current signal at the first time instant. In other words, the control unit may be configured to take into account a delay within the control loop (or regulation loop) comprising the current sensing means, a controller or regulator, a driver for the switch and/or the switch. The control unit may be configured to switch off the switch at a time instant when the current through the switch reaches a pre-determined peak current. The delay may lead to the effect that the sensed current signal at the first time instant does not clearly indicate the current through the switch at the second time instant. In particular, this may be the case if a current offset caused by the delay is not constant. As such, the control unit may not be able to reliably determine the time instant when the current through the switch reaches the pre-determined peak current, based on the sensed current signal alone.

It has been observed that the delay-induced current offset may depend on the input voltage. As a consequence, by providing information regarding the input voltage to the control unit, the control unit may be configured to correctly estimate and compensate the delay-induced current offset. In other words, the control unit may be configured to determine an estimate of the current through the switch at the second time instant based on the sensed current signal at the first time instant, and using the sensed voltage signal (e.g. at the first time instant).

The switched-mode power converter may comprise an inductor having an inductance L. The inductor may be arranged in series with the switch. The inductor may e.g. be part of a transformer (as is the case e.g. in a flyback converter). The inductor may be used to store energy during an on-state of the switch and to transfer the energy stored within the inductor to the output of the power converter during an off-state of the switch. By way of example, the driver circuit of the power converter may comprise an output capacitor (parallel to the output voltage) at the output of the switched-mode power converter. The output capacitor may be configured to store an electrical charge to be provided to the solid state light source. The driver circuit (and in particular the power converter) may be configured to transfer electrical energy from the inductor of the switched-mode power converter to the output capacitor during the off-state of the switch.

The control unit may be configured to compensate for the delay also based on the inductance L. In other words, the control unit may take into account the inductance L for determining the gate control signal, notably for determining the time instant for switching off the switch. In yet other words, the inductance L may be taken into account to estimate and/or compensate the delay-induced current offset. In particular, the control unit may be configured to determine an estimate of the current through the switch at the second time instant based on the rule $$Id = \frac{Vin \times Td}{L}$$

wherein Vin is the input voltage, Td is the delay and Id is the delay-induced current offset between the sensed current signal at the first time instant and the estimate of the current through the switch at the second time instant. In other words, the control unit may be configured to compensate the current offset Id based on the above mentioned rule.

The control unit may be configured to incorporate the sensed voltage signal into the control loop in the analog domain. By way of example, the control unit may comprise a transistor arranged in series with a first resistor, wherein the transistor is controlled using the sensed voltage signal, thereby yielding a first signal. Furthermore, the control unit may comprise a reference unit configured to offset the first signal, thereby yielding a correction signal. The reference unit may comprise a reference resistor and a reference current source arranged in parallel to the transistor and the first resistor. The reference resistor and/or the reference current source may depend on the inductance L. In addition, the control unit may comprise a comparator unit configured to compare the sensed current signal with the correction signal to yield an offset current signal. The gate control signal (and in particular the time instant for switching off the switch) may then be determined based on the offset current signal.

In addition, the control unit may comprise a fine tuning unit configured to compensate for temperature variations and/or for component variations. Parameters of the fine tuning unit may e.g. be determined during a calibration phase. These parameters may be stored and may be provided to and used by the control unit. Alternatively or in addition, typical values for the parameters may be programmed and/or look-up tables which provide parameter values in a voltage/temperature dependent manner may be provided to the control unit.

It should be noted that the control unit may be configured to perform regulation/control in the digital domain. By way of example, the control unit may comprise a digital controller. In particular, the control unit may comprise an analog-to-digital converter for converting the sensed current signal and the sensed voltage signal into respective digital signals. Furthermore, the control unit may be configured to determine the gate control signal in the digital domain based on the digital signals. In addition, the control unit may take into account temperature data provided by a temperature sensor and/or calibration data indicative of component variations provided by a storage device (e.g. an OTP, one time programmable memory). It should be noted that the PSRR behavior is particularly impacted in case of regulation/control in the digital domain, as in such cases the signal processing may incur additional delays which should be compensated.

According to a further aspect, a light bulb assembly is described. The light bulb assembly comprises a housing and a solid state light emitting device, located within the housing. Furthermore, the light bulb assembly may comprise an electrical connection module, attached to the housing, and adapted for connection to a mains supply. In addition, the light bulb assembly may comprise a driver circuit according to any of the aspects outlined in the present document, located within the housing, connected to receive an electricity supply signal from the electrical connection module, and operable to supply an output voltage to the light emitting device.

According to another aspect, a method for operating a control unit and/or a driver circuit as outlined in the present document is described. The method may comprise steps which correspond to the features of the controller and/or driver circuit described in the present document. In particular, a method for operating a driver circuit is described. The method may comprise controlling the switch of a switched-mode power converter such that an input voltage at an input of the switched-mode power converter is converted into an output voltage at an output of the switched-mode power converter. In addition, the method comprises determining a sensed current signal indicative of a current through the switch, and determining a sensed voltage signal indicative of the input voltage. Furthermore, the method comprises determining a gate control signal for putting the switch into an off-state, based on the sensed current signal and based on the sensed voltage signal, such that a degree of modulations comprised within the output voltage and/or a degree of modulations comprised within a current provided at the output of the switched-mode power converter is reduced with respect to a degree of modulations comprised within the input voltage.

According to a further aspect, a software program is described. The software program may be adapted for execution on a processor and for performing the method steps outlined in the present document when carried out on the processor.

According to another aspect, a storage medium is described. The storage medium may comprise a software program adapted for execution on a processor and for performing the method steps outlined in the present document when carried out on the processor.

According to a further aspect, a computer program product is described. The computer program may comprise executable instructions for performing the method steps outlined in the present document when executed on a computer.

It should be noted that the methods and systems including its preferred embodiments as outlined in the present document may be used stand-alone or in combination with the other methods and systems disclosed in this document. In addition, the features outlined in the context of a system are also applicable to a corresponding method. Furthermore, all aspects of the methods and systems outlined in the present document may be arbitrarily combined. In particular, the features of the claims may be combined with one another in an arbitrary manner.

In the present document, the term "couple" or "coupled" refers to elements being in electrical communication with each other, whether directly connected e.g., via wires, or in some other manner.

SHORT DESCRIPTION OF THE FIGURES

The invention is explained below in an exemplary manner with reference to the accompanying drawings, wherein FIG. 1*a* illustrates a block diagram of an example light bulb assembly;

FIG. 1*b* illustrates the impact of an example delay on the sensed current of the switch of a switched-mode power converter;

DETAILED DESCRIPTION

In the present document, a light bulb "assembly" includes all of the components required to replace a traditional incandescent filament-based light bulb, notably light bulbs for connection to the standard electricity supply. In British English (and in the present document), this electricity supply is referred to as "mains" electricity, whilst in US English, this supply is typically referred to as power line. Other terms include AC power, line power, domestic power and grid power. It is to be understood that these terms are readily interchangeable, and carry the same meaning.

Typically, in Europe electricity is supplied at 230-240 VAC, at 50 Hz (mains frequency) and in North America at 110-120 VAC at 60 Hz (mains frequency). The principles set out in the present document apply to any suitable electricity supply, including the mains/power line mentioned, and a DC power supply, and a rectified AC power supply.

Figure 1A:
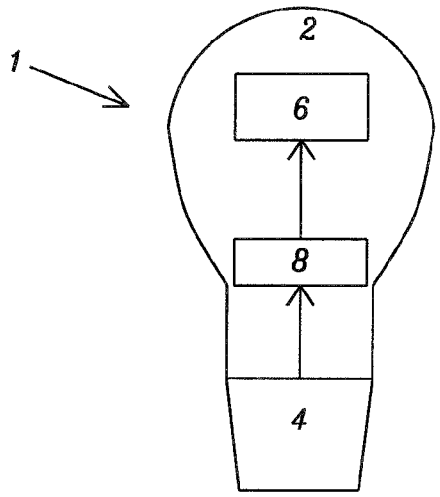

FIG. 1*a* is a schematic view of a light bulb assembly. The assembly 1 comprises a bulb housing 2 and an electrical connection module 4. The electrical connection module 4 can be of a screw type or of a bayonet type, or of any other suitable connection to a light bulb socket. Typical examples for an electrical connection module 4 are the E11, E14 and E27 screw types of Europe and the E12, E17 and E26 screw types of North America. Furthermore, a light source 6 (also referred to as an illuminant) is provided within the housing 2. Examples for such light sources 6 are a CFL tube or a solid state light source 6, such as a light emitting diode (LED) or an organic light emitting diode (OLED) (the latter technology is referred to as solid state lighting, SSL). The light source 6 may be provided by a single light emitting device, or by a plurality of LEDs.

Driver circuit 8 is located within the bulb housing 2, and serves to convert supply electricity received through the electrical connection module 4 into a controlled drive current for the light source 6. In the case of a solid state light source 6, the driver circuit 8 is configured to provide a controlled direct drive current to the light source 6.

The housing 2 provides a suitably robust enclosure for the light source and drive components, and includes optical elements that may be required for providing the desired output light from the assembly. The housing 2 may also provide a heat-sink capability, since management of the temperature of the light source may be important in maximising light output and light source life. Accordingly, the housing is typically designed to enable heat generated by the light source to be conducted away from the light source, and out of the assembly as a whole.

Figure 2:
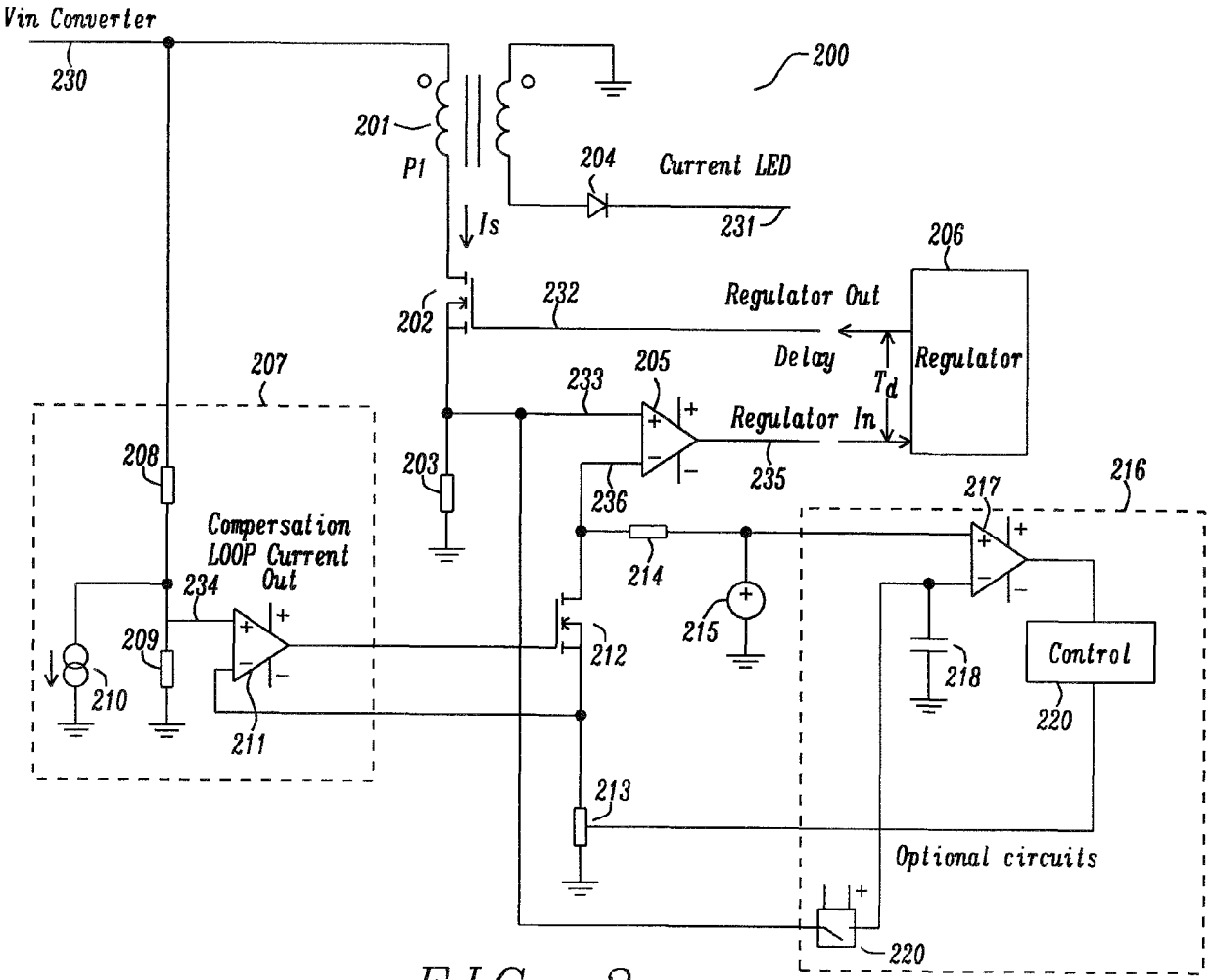
FIG. 2 illustrates a block diagram of an example power converter.

FIG. 2 illustrates a block diagram of an example switched-mode power converter 200. In the illustrated example, the power converter 200 is a flyback converter comprising a transformer 201. Other examples for switched-mode power converters are buck converters, boost converters, buck-boost converters or Single-ended primary-inductor converters (SEPIC). The switched-mode power converter 200 is configured to convert an input voltage 230 into an output voltage 231 for a light source 6 (not illustrated). The power converter 200 comprises a switch 202 (e.g. a transistor such as a metal oxide semiconductor, MOS, field effect transistor, FET). The switch 202 is controlled via a gate control signal 232 (e.g. a gate voltage) which is configured to put the switch 202 into an on-state and an off-state in an alternating rate at a commutation cycle rate (e.g. 100 kHz) and with a particular duty cycle (wherein the duty cycle indicates the duration of an on-state relative to the duration of a commutation cycle). Furthermore, the power converter 200 comprises a diode 204 which is configured to prevent a reverse energy flow from the output of the power converter 200 to the input of the power converter 200 during an off-state of the switch 202.

The power converter 200 (in particular the switch 202) may be controlled using a regulator 206. The regulator 206 may receive a regulator input signal 235 which is derived from a current Is through the switch 202 (i.e. a current through the primary side P1 of the transformer 201 which is arranged in series to the switch 202). The current Is through the switch 202 may be determined using current sensing means 203. In the illustrated example, the current sensing means 203 comprise a shunt resistor arranged in series with the switch 202, thereby providing a sensed current signal 233 (which corresponds to the voltage drop across the shunt resistor 203, i.e. which is proportional to the current through the switch 202).

The regulator 206 may be configured to generate the gate control signal 232 based on the regulator input signal 235 which may be derived from the current Is through the switch 202. By way of example, the regulator 206 may be configured to turn off the switch 202 once the current Is through the switch 202 has received a pre-determined peak current Ip. Typically, the control loop from the current sensing means 203 via the regulator 206 to the gate of the switch 202 comprises an overall delay Td which may be in the range of e.g. 200 ns or 250 ns. As a result of such a delay Td, the gate control signal 232 at a time instant T which is generated based on a sensed current signal 233 at the time instant T-Td may not ensure that the switch 202 is put to the off-state at the time instant when the current Is through the switch 202 reaches the pre-determined peak current Ip.

Figure 4:
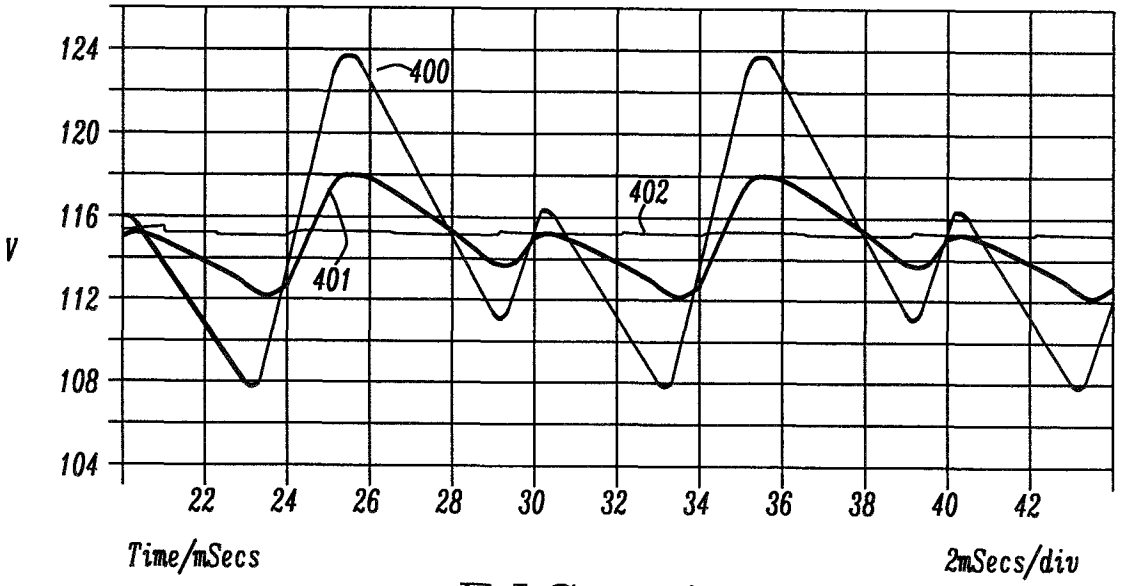
FIG. 4 illustrates example experimental results.

Furthermore, it should be noted that the input voltage 230 of FIG. 2 of the power converter 200 may comprise modulations which may be due to various sources, e.g. due to a rectifier comprised within the driver circuit 8 of the light bulb assembly 1, and/or due to distortions comprised within the mains supply which may be due to the use of a phase-cut dimmer. These modulations of the input voltage 230 may lead to modulations of the output voltage 231 and modulations of the current provided to the light source 6, which could cause undesirable flickering effects at the light source 6. This is illustrated in FIG. 4, where it can be seen how a modulation 400 of the input voltage 230 leads to a modulation 401 of the output voltage 231.

As such, it is desirable to enable a regulation of the power converter 200 of FIG. 2 (using the regulator 206) which allows compensating such modulations of the input voltage 230. As indicated above, the switch 202 should be regulated such that the switch 202 is turned off as soon as the current Is through the switch 202 reaches the pre-determined peak current Ip. For this purpose, a sensed current signal 233 is determined. The regulator 206 may be configured to take into account the (fixed) delay Td of the regulation loop when generating the gate control signal 232 (e.g. the gate voltage) for controlling the state of the switch 202. This delay Td may be used to determine an estimate of the current Is through the switch 202 at a time instant T, when the sensed current signal 233 at the time instant T-Td is known.

Figure 1B:
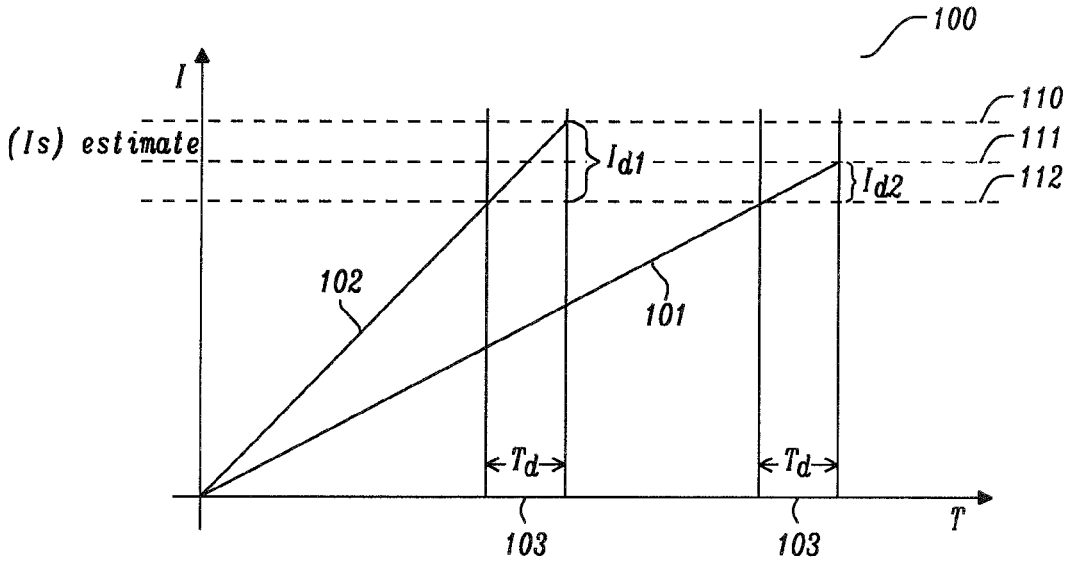

This is illustrated in FIG. 1*b*. The current through the switch 202 ramps up according to a ramp 101 which depends on the inductance L of the transformer 201. The regulator 206 may make use of the ramp 101 to determine an estimate 111 of the current Is through the switch 202 at time instant T based on a sensed current signal 112, 233 at time instant T-Td, with Td being illustrated by reference numeral 103. As such, under the assumption of a stable input voltage 230, the regulator 206 may compensate the delay Td 103 using the ramp 101.

However, as indicated above, the input voltage 230 cannot typically be regarded as being stable. The input voltage 230 typically comprises modulations, notably in cases where the mains supply has been submitted to a phase-cut dimmer. As a result, the ramp 101 of FIG. 1*b* may vary. This may be seen when analyzing the circuit diagram of FIG. 2. When the switch 202 is in on-state, the current Is through the switch 202 is given by $$L \times \frac{dIs}{dt} = V$$

wherein the voltage V may be approximated by the input voltage Vin 230. As such, the current Is through the switch 202 is given by $$Is = \int \frac{Vin}{L} dt = \frac{Vin \times T}{L}$$

wherein T represents a time interval. It should be noted that there may be other factors, which have an influence of the delay and behavior of the control loop. The above mentioned equation typically shows the most dominant factor. A fine tuning of the control loop, which takes into account other factors may e.g. be performed during printed circuit board (PCB) calibration of the driver circuit and/or during calibration of the assembled light bulb. During calibration, the second order effects can be adjusted. Hence, the current Is through the switch 202 also depends on the input voltage Vin 230 and variations of the input voltage Vin 230 lead to variations of the ramp 101. This is illustrated in FIG. 1*b* where a second ramp 102 is illustrated, wherein the input voltage 230 for ramp 102 is higher than the input voltage 230 for ramp 101. It can be seen that due to the higher input voltage 230 (and the resulting higher slope of ramp 102), the current offset Id1 between the current Is through the switch 202 at time instant T and the sensed current signal 233 at time instant T-Td differs from the current offset Id2 for the lower input voltage 230 (corresponding to ramp 101). The current offset Id for the delay Td may be expressed as $$Id = \frac{Vin \times Td}{L}$$

As a consequence, the regulator 206 cannot correctly compensate the delay Td 103 if only the sensed current signal 233 is known, because the current offset Id also depends on the input voltage 230. In view of this, it is proposed to make the regulation of the switch 202 (notably for the determination of the switch-off time instants for the switch 202) also dependent on the input voltage 230. For this purpose, input voltage sensing means 207 may be provided which are configured to determine a sensed voltage signal 234 which is indicative of (e.g. proportional to) the input voltage 230. In the illustrated example of FIG. 2, the input voltage sensing means 207 comprise a voltage divider with the resistors 208, 209. Furthermore, the input voltage sensing means 207 may comprise a current source 210 which is configured to offset the sensed voltage signal 234 (e.g. for tuning purposes). In addition, the input voltage sensing means 207 may comprise an operational amplifier 211 for amplifying/offsetting the sensed voltage signal 234.

As such, the gate control signal 232 may be determined based on the sensed current signal 233 and based on the sensed voltage signal 234. By doing this, it can be ensured that during regulation the correct offset Id is taken into account when compensating for the delay Td of the regulation loop (also referred to as control loop). The regulation may be performed in an analog manner (as illustrated e.g. in FIG. 2) or in a digital manner (as illustrated e.g. in FIG. 3).

FIG. 2 illustrates an example regulation loop which is configured to compensate the voltage dependence of the offset current Id in the analog domain. The sensed voltage signal 234 (which is indicative of the input voltage 230) may be used to control a transistor 212 which is used in its linear region, i.e. which is used as a current source. By doing this, a correction signal 236 may be generated which is used to offset the sensed current signal 233, thereby yielding the offset current signal 235 as an input to the regulator 206. A comparator unit 205 (e.g. an operational amplifier) may be used to determined the offset current signal 235 by offsetting the sensed current signal 233 with the correction signal 236.

The effect of the correction signal 236 is illustrated in FIG. 1*b*. If it is assumed that the sensed current signal 233 corresponds to the current 112, the offset current signal 235 may be such that in case of a first input voltage 230 (corresponding to ramp 101), the offset current signal 235 corresponds to current 111; and that in case of a second input voltage 230 (corresponding to ramp 102), the offset current signal 235 corresponds to current 110. As a result, the regulator 206 may determine the gate control signal 232 based on the offset current signal 235, wherein the offset current signal 235 takes into account variations of the input voltage 230. This leads to a control of the switch 202 which allows compensating for variations of the input voltage 230.

This is illustrated in FIG. 4 which shows the output voltage 402 obtained when taking into account the input voltage 230 for controlling the switch 202. It can be seen that the modulations of the input voltage 230 can be compensated by the regulator 206, thereby yielding a stable output voltage 402 in FIG. 4 and 231 in FIG. 2.

The generation of the correction signal 236 may make use of various tuning components. In particular, an operational point of the correction signal 236 may be set using the reference circuitry 214, 215. The reference circuitry 214, 215 comprises a resistor 214 and a voltage source 215. The reference circuitry 214, 215 is configured to offset the signal provided by the current source 212, thereby offsetting the correction signal 236 by a pre-determined amount. Hence, the sensed voltage signal 234 may control the current source 212 via the operational amplifier 211 such that the sensed voltage signal 234 is converted into a current which may offset a reference current provided by the reference circuitry 214, 215, thereby yielding the correction signal 236.

Furthermore, fine tuning circuitry 216 may be used to fine tune the correction signal 236. The fine tuning circuitry 216 may be adjusted during a calibration phase of the light bulb assembly 1. The fine tuning circuitry 216 comprises e.g. a sample-and-hold unit 220, 218 which is configured to sample the sensed current signal 233 at a particular time instant. The sampled signal may be compared (using a comparing unit 217) to the signal provided by the voltage source 215, and the difference signal may be used to control an adjustable resistor 213 (using the control unit 220), thereby adjusting the correction signal 236. FIG. 2 shows an example analog implementation for fine tuning. Typically such a circuit is not able to make a 100% calibration, because the fine tuning circuitry 216 does not have direct access to the delay of the external switch 202. The delay caused by the external switch 202 can e.g. be eliminated by system calibration or by an additional compensation, which can be programmable.

Figure 3:
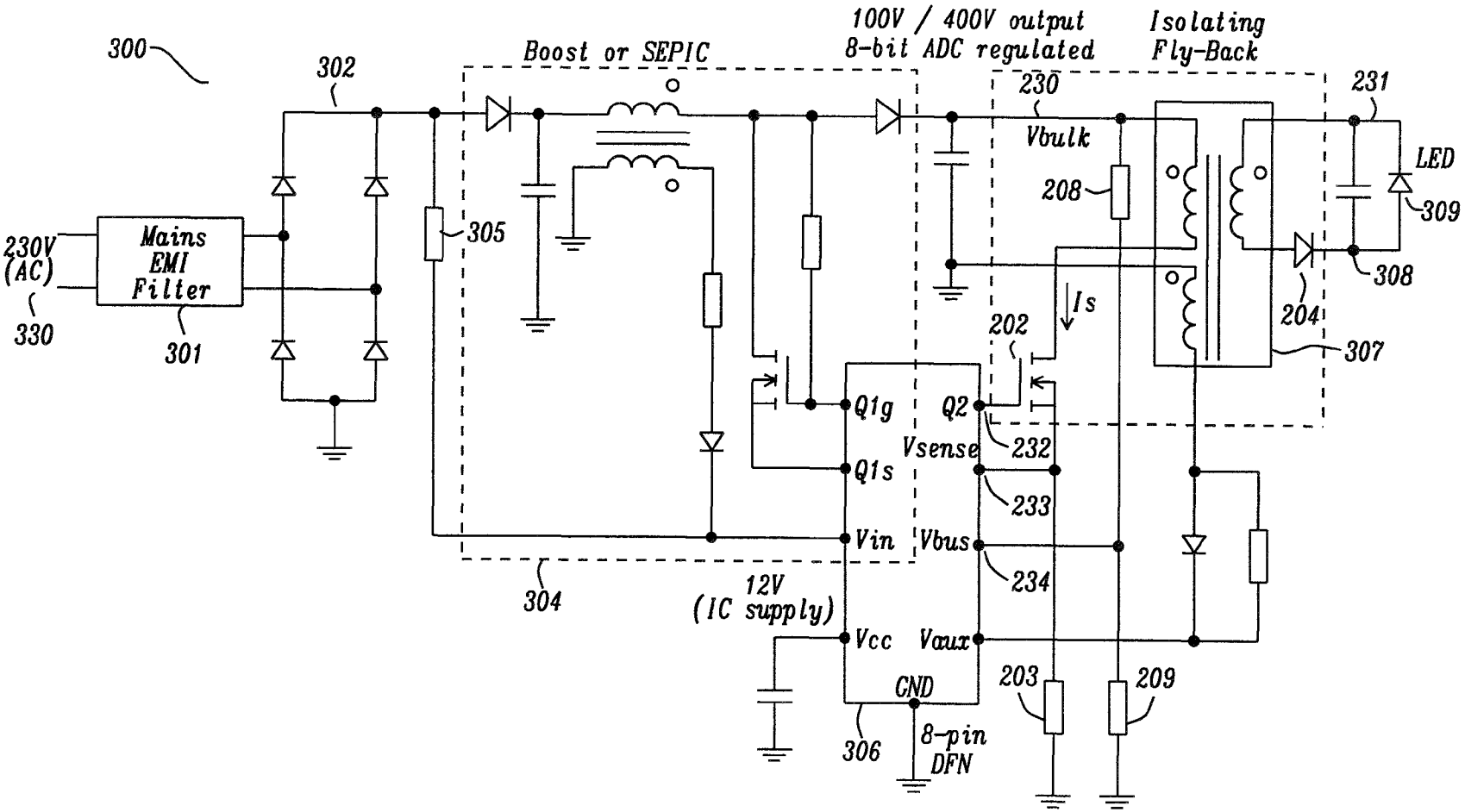
FIG. 3 shows a circuit diagram of an example driver circuit.

As indicated above, the voltage-dependent control of the switch 202 may alternatively or in addition be performed in the digital domain. This is illustrated in FIG. 3. FIG. 3 shows a circuit diagram of an example driver circuit 300, 8 of a light bulb assembly 1. The driver circuit 300 comprises an electromagnetic interference (EMI) filter unit 301 and a rectifier 302, in order to generate a rectified voltage from the main supply 330. Furthermore, the driver circuit 300 comprises a controller 306 which is configured to control a two-stage power converter. The controller 306 may be started using the start-up resistor 305. In the illustrated example, the driver circuit 300 comprises a two-state power converter with the first stage being a Boost converter 304 and the second stage being a flyback converter as shown e.g. in FIG. 2. The flyback converter of FIG. 3 comprises a transformer 307 having an additional auxiliary coil for measurement purposes. The auxiliary winding may be used to provide information to the controller 306 regarding the output voltage 231 of the driver circuit 300. Furthermore, the driver circuit 300 comprises an output capacitor (or storage capacitor) 308 which stores the energy to be provided to the light source 6, 309.

In a similar manner to FIG. 2, the input voltage 230 (which in FIG. 3 is the input voltage to the second converter stage) is sensed using input voltage sensing means 208, 209, thereby providing the sensed voltage signal 234. Furthermore, the sensed current signal 233 is determined using current sensing means 203. The controller 306 may be configured to determine a gate control signal 232 for putting the switch 202 of the second converter stage into an off-state once the current Is through the switch 202 reaches a pre-determined peak current Ip. For this purpose, the controller 306 may make use of the sensed current signal 233 and of the sensed voltage signal 234, thereby ensuring that variations of the input voltage 230 can be compensated and corresponding variations of the output voltage 231 may be reduced or avoided, thereby reducing or preventing a flickering effect of the light source 309.

As outlined above, in the present document, a power converter and a driver circuit for solid state light sources are described. Furthermore, control schemes for controlling the one or more switches comprised within the power converter/driver circuit are described.

Due to safety isolation requirements which have to be met by light bulb assemblies 1, the current through the light source 6, 309 cannot typically be sensed and regulated directly. For this so called "primary side control" techniques may be used which regulate the current through the light source 6, 309 indirectly using signal processing. As outlined above, the current Is through the power converter switch 202 may be used to regulator the current through the light source 6, 309. These indirect methods are limited in accuracy and dynamic range. In particular, the chain of propagation delays between turn-on of the power switch 202 and the sensing of the respective current Is may cause a substantial impact of the input voltage 230 onto the current provided to the light source 6, 309. As a consequence, the light-output may be subject to flicker and inaccuracies. To overcome these limits it is proposed to introduce a feedforward compensation path. The feedforward compensation path may make use of a sensed voltage signal 234 which is indicative of the input voltage 230, thereby maintaining the current through the light source 6, 309 virtually constant for a wide range of input voltages 230. Furthermore, the feedforward compensation path may use calibration data for maintaining the current through the light source 6, 309 virtually constant for a wide range of input voltages 230.

Notably when using digital regulators 206, 306 dead times or delays Td may occur. The dead times produce an incorrect measurement of the current through the light source 6, 309 by only measuring the primary side transformer current Is. As outlined above, a compensation of the dead times may be used to obtain an accurate estimate of the current at the primary side.

It is proposed to compensate the delay Td in the regulation loop (e.g. caused by the operational amplifier 205 in FIG. 2, by the driver of the FET switch 202 and/or by the regulator 206). The delay Td is typically a constant value, without considering variations caused by the manufacturing process and the temperature. As outlined in conjunction with FIG. 1*b*, the current at the shunt resistor 203 typically depends on the input voltage Vin 230 and on the time constant L of the coil of the transformer 201. A reference (i.e. the correction signal 236) of the comparator 205 may be modulated in respect of the input voltage 230 and thereby generates an offset current signal 235, which may be used for a stable regulation of the switch 202.

The optional circuit 216 may allow for a fine tuning for manufacturing process variations and/or for temperature drifts. Additionally or alternatively, a fine tuning can be performed during a circuit test and/or a calibration of the light bulb assembly 1. In other words, fine tuning can also be done with OTP (one time programmable) or Flash EEPROM or other programming storage calibration.

Figure 5:
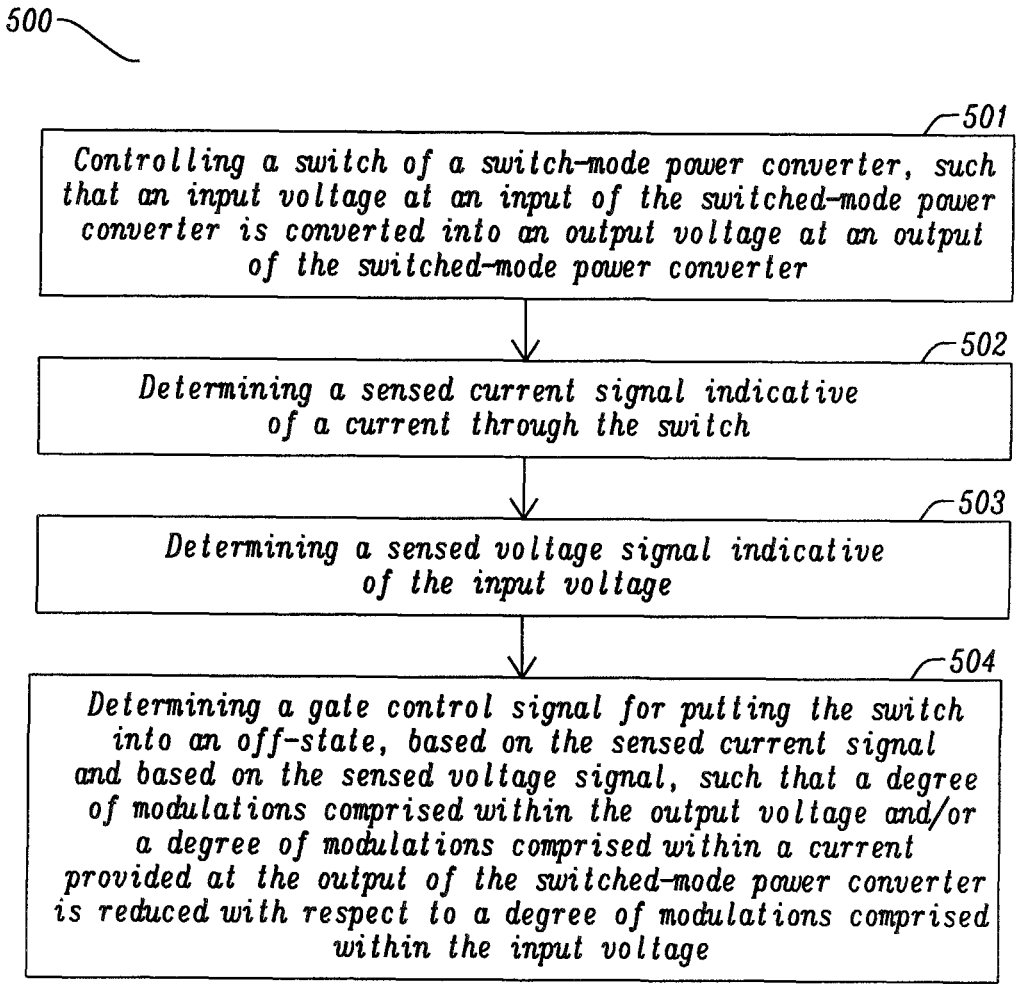
FIG. 5 shows a flow chart of an example method for operating a driver circuit.

FIG. 5 shows a flow chart of an example method 500 for operating a driver circuit 300. The method 500 comprises the step of controlling 501 a switch 202 of a switched-mode power converter 200, such that an input voltage 230 at an input of the switched-mode power converter 200 is converted into an output voltage 231 at an output of the switched-mode power converter 200. Furthermore, the method 500 comprises the step of determining 502 a sensed current signal 233 indicative of a current through the switch 202, and the step of determining 503 a sensed voltage signal 234 indicative of the input voltage 230. In addition, the method comprises the step of determining 504 a gate control signal 232 for putting the switch 202 into an off-state, based on the sensed current signal 233 and based on the sensed voltage signal 234, such that a degree of modulations comprised within the output voltage 231 and/or a degree of modulations comprised within a current provided at the output of the switched-mode power converter 200 is reduced with respect to a degree of modulations comprised within the input voltage 230.

It should be noted that the description and drawings merely illustrate the principles of the proposed methods and systems. Those skilled in the art will be able to implement various arrangements that, although not explicitly described or shown herein, embody the principles of the invention and are included within its spirit and scope.

Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A driver circuit for a solid state light source, wherein the driver circuit comprises a switched-mode power converter comprising a switch; wherein the switched-mode power converter is configured to convert an input voltage at an input of the switched-mode power converter into an output voltage at an output of the switched-mode power converter;

a current sensing circuit configured to determine a sensed current signal indicative of a current through the switch;

voltage sensing circuit configured to determine a sensed voltage signal indicative of the input voltage; and a control unit configured to determine a gate control signal for putting the switch into an off-state, based on the sensed current signal and based on the sensed voltage signal, such that a degree of modulations comprised within the output voltage and/or a degree of modulations comprised within a current provided at the output of the switched-mode power converter is reduced with respect to a degree of modulations comprised within the input voltage, wherein the control unit is configured to compensate for a delay between a first time instant when the sensed current signal is determined and a second time instant when the switch is put into the off-state, subject to the gate control signal which corresponds to the sensed current signal at the first time instant.

2. The driver circuit of claim 1, wherein the control unit is configured to determine an estimate of the current through the switch at the second time instant based on the sensed current signal at the first time instant, using the sensed voltage signal.

3. The driver circuit of claim 1, wherein the switched-mode power converter comprises an inductor having an inductance L, arranged in series with the switch; and the control unit is configured to compensate for the delay also based on the inductance L.

4. The driver circuit of claim 3, wherein the control unit is configured to determine an estimate of the current through the switch at the second time instant based on the rule $$Id = \frac{Vin \times Td}{L}$$

wherein Vin is the input voltage, Td is the delay and Id is an offset between the sensed current signal at the first time instant and the estimate of the current through the switch at the second time instant.

5. The driver circuit of claim 1, wherein the control unit comprises a transistor arranged in series with a first resistor, wherein the transistor is controlled using the sensed voltage signal, thereby yielding a first signal;

a reference unit configured to offset the first signal, thereby yielding a correction signal; and a comparator unit configured to compare the sensed current signal with the correction signal to yield an offset current signal; wherein the gate control signal is determined based on the offset current signal.

6. The driver circuit of claim 5, wherein the reference unit comprises a reference resistor and a reference current source arranged in parallel to the transistor and the first resistor; and the reference resistor and/or the reference current source depend on the inductance L.

7. The driver circuit of claim 5, wherein the control unit comprises a fine tuning unit configured to compensate for temperature variations and/or for component variations.

8. The driver circuit of claim 1, wherein the control unit comprises an analog-to-digital converter for converting the sensed current signal and the sensed voltage signal into respective digital signals; and the control unit is configured to determine the gate control signal in the digital domain based on the digital signals.

9. The driver circuit of claim 1, wherein the current sensing circuit comprise a current sensing resistor arranged in series to the switch.

10. The driver circuit of claim 1, wherein the voltage sensing circuit comprise a voltage divider arranged in parallel to the input of the switched-mode power converter; and/or an auxiliary winding of a transformer comprised within the switched-mode power converter.

11. The driver circuit of claim 1, wherein the switched-mode power converter comprises one or more of: a flyback converter, a buck converter, a boost converter, a buck-boost converter, and a single-ended primary-inductor converter.

12. The driver circuit of claim 1, further comprising an output capacitor at the output of the switched-mode power converter, configured to store an electrical charge to be provided to the solid state light source; wherein the driver circuit is configured to transfer electrical energy from an inductor of the switched-mode power converter to the output capacitor during the off-state of the switch.

13. A light bulb assembly comprising:

a housing;

a solid state light source, located within the housing;

an electrical connection module, attached to the housing, and adapted for connection to a mains supply; and a driver circuit, located within the housing, connected to receive an electricity supply signal from the electrical connection module, and operable to supply an output voltage to the light source, wherein the driver circuit comprises a switched-mode power converter comprising a switch; wherein the switched-mode power converter is configured to convert an input voltage at an input of the switched-mode power converter into an output voltage at an output of the switched-mode power converter;

a current sensing circuit configured to determine a sensed current signal indicative of a current through the switch;

a voltage sensing circuit configured to determine a sensed voltage signal indicative of the input voltage; and a control unit configured to determine a gate control signal for putting the switch into an off-state, based on the sensed current signal and based on the sensed voltage signal, such that a degree of modulations comprised within the output voltage and/or a degree of modulations comprised within a current provided at the output of the switched-mode power converter is reduced with respect to a degree of modulations comprised within the input voltage, wherein the control unit is configured to compensate for a delay between a first time instant when the sensed current signal is determined and a second time instant when the switch is put into the off-state, subject to the gate control signal which corresponds to the sensed current signal at the first time instant.

14. A method for operating a driver circuit, the method comprising controlling a switch of a switched-mode power converter such that an input voltage at an input of the switched-mode power converter is converted into an output voltage at an output of the switched-mode power converter;

determining a sensed current signal indicative of a current through the switch;

determining a sensed voltage signal indicative of the input voltage; and determining a gate control signal for putting the switch into an off-state, based on the sensed current signal and based on the sensed voltage signal, such that a degree of modulations comprised within the output voltage and/or a degree of modulations comprised within a current provided at the output of the switched-mode power converter is reduced with respect to a degree of modulations comprised within the input voltage wherein the control unit compensates for a delay between a first time instant when the sensed current signal is determined and a second time instant when the switch is put into the off-state, subject to the gate control signal which corresponds to the sensed current signal at the first time instant.

15. The method for operating a driver circuit of claim 14, wherein the control unit determines an estimate of the current through the switch at the second time instant based on the sensed current signal at the first time instant, using the sensed voltage signal.

16. The method for operating a driver circuit of claim 14, wherein the switched-mode power converter comprises an inductor having an inductance L, arranged in series with the switch; and the control unit compensates for the delay also based on the inductance L.

17. The method for operating a driver circuit of claim 16, wherein the control unit determines an estimate of the current through the switch at the second time instant based on the rule $$Id = \frac{Vin \times Td}{L}$$

wherein Vin is the input voltage, Td is the delay and Id is an offset between the sensed current signal at the first time instant and the estimate of the current through the switch at the second time instant.

18. The method for operating a driver circuit of claim 14, wherein the control unit comprises a transistor arranged in series with a first resistor, wherein the transistor is controlled using the sensed voltage signal, thereby yielding a first signal;

a reference unit which offsets the first signal, thereby yielding a correction signal; and a comparator unit which compares the sensed current signal with the correction signal to yield an offset current signal; wherein the gate control signal is determined based on the offset current signal.

19. The method for operating a driver circuit of claim 18, wherein the reference unit comprises a reference resistor and a reference current source arranged in parallel to the transistor and the first resistor; and the reference resistor and/or the reference current source depend on the inductance L.

20. The method for operating a driver circuit of claim 18, wherein the control unit comprises a fine tuning unit which compensates for temperature variations and/or for component variations.

21. The method for operating a driver circuit of claim 14, wherein the control unit comprises an analog-to-digital converter for converting the sensed current signal and the sensed voltage signal into respective digital signals; and the control unit determines the gate control signal in the digital domain based on the digital signals.

22. The method for operating a driver circuit of claim 14, wherein the current sensing circuit comprise a current sensing resistor arranged in series to the switch.

23. The method for operating a driver circuit of claim 14, wherein the voltage sensing circuit comprise a voltage divider arranged in parallel to the input of the switched-mode power converter; and/or an auxiliary winding of a transformer comprised within the switched-mode power converter.

24. The method for operating a driver circuit of claim 14, wherein the switched-mode power converter comprises one or more of: a flyback converter, a buck converter, a boost converter, a buck-boost converter, and a single-ended primary-inductor converter.

25. The method for operating a driver circuit of claim 14, further comprising an output capacitor at the output of the switched-mode power converter, to store an electrical charge to be provided to the solid state light source; wherein the driver circuit transfers electrical energy from an inductor of the switched-mode power converter to the output capacitor during the off-state of the switch.

* * * * *